US006075232A

United States Patent [19]

Joines et al.

[11] Patent Number: 6,075,232

[45] **Date of Patent: *Jun. 13, 2000**

[54] METHOD AND APPARATUS FOR ELECTROMAGNETIC EXPOSURE OF PLANAR OR OTHER MATERIALS

[75] Inventors: William T. Joines; J. Michael Drozd, both of Durham, N.C.

[73] Assignee: Industrial Microwave Systems, Inc., Morrisville, N.C.

[ * ] Notice: This patent is subject to a terminal disclaimer.

[21] Appl. No.: 09/332,592

[22] Filed: Jun. 14, 1999

Related U.S. Application Data

[62] Division of application No. 08/848,244, Apr. 29, 1997, Pat. No. 5,958,275.

[51] Int. Cl.[7] ..... H05B 6/78

[52] U.S. Cl. ..... 219/695; 219/745; 219/746; 219/738; 219/693

[58] Field of Search ..... 219/691, 692, 219/693, 695, 696, 697, 699, 700, 701, 738, 741, 742, 745, 746, 750; 174/35 R, 35 MS, 35 GC

[56] References Cited

U.S. PATENT DOCUMENTS

| | | | |
|---|---|---|---|
| Re. 32,664 | 5/1988 | Osepchuk . | |
| 2,549,511 | 4/1951 | Nelson . | |
| 3,471,672 | 10/1969 | White . | |
| 3,474,209 | 10/1969 | Parker . | |
| 3,622,733 | 11/1971 | Smith et al. . | |
| 3,632,945 | 1/1972 | Johnson . | |
| 3,666,905 | 5/1972 | Muller et al. . | |
| 3,699,899 | 10/1972 | Schiffmann et al. | 219/701 |
| 3,765,425 | 10/1973 | Stungis et al. . | |
| 3,843,861 | 10/1974 | Van Amsterdam . | |
| 4,108,147 | 8/1978 | Kantor . | |
| 4,160,144 | 7/1979 | Kashyap et al. . | |
| 4,401,873 | 8/1983 | Berggren et al. . | |
| 4,446,348 | 5/1984 | Huang et al. . | |
| 4,760,230 | 7/1988 | Hässler . | |
| 4,999,469 | 3/1991 | Dudley et al. . | |
| 5,169,571 | 12/1992 | Buckley . | |
| 5,369,250 | 11/1994 | Meredith . | |
| 5,402,672 | 4/1995 | Bradford . | |
| 5,457,303 | 10/1995 | Shute et al. . | |
| 5,536,921 | 7/1996 | Hedrick et al. . | |

*Primary Examiner*—Philip H. Leung
*Attorney, Agent, or Firm*—Burns, Doane, Swecker & Mathis, L.L.P.

[57] ABSTRACT

The present invention overcomes many of the problems associated with electromagnetic exposure of planar materials. A diagonal slot compensates for the effects of signal attenuation along the propagation path. Adjustably variable path lengths allow peaks and valleys of the electromagnetic field in one exposure segment to compensate for peaks and valleys in another exposure segment. Dielectric slabs may be used to extend the peak field region between top and bottom conducting surfaces to allow for more uniform exposure of planar materials that have a significant thickness. Specialized choke flanges prevent the escape of electromagnetic energy. One or more rollers between exposure segments may be enclosed by an outer surface to prevent the escape of electromagnetic energy.

17 Claims, 10 Drawing Sheets

METHOD AND APPARATUS FOR ELECTROMAGNETIC EXPOSURE OF PLANAR OR OTHER MATERIALS

This application is a divisional of application Ser. No. 08/848,244, filed Apr. 29, 1997 U.S. Pat No. 5,958,275.

FIELD OF THE INVENTION

This invention relates to electromagnetic energy and more particularly to electromagnetic exposure of planar materials.

BACKGROUND OF THE INVENTION

In recent years, interest in using microwave signals for applications in many industrial settings has grown dramatically. One such setting is the heating of paper or other planar materials. Slotted waveguides have long been used for exposing planar materials to microwave energy. It is well known in the art to use a slotted wave guide that has a serpentine propagation path in order to maximize the exposure area of sheets passed through the guide. See, e.g., U.S. Pat. No. 5,169,571; U.S. Pat. No. 4,446,348; and U.S. Pat. No. 3,765,425.

Currently, the use of serpentine slotted waveguides for heating planar materials has four particular drawbacks. First, the microwave signal attenuates as it moves away from its source. This attenuation versus propagation distance increases when lossy planar materials are introduced into the waveguide. As a result, a material fed into the waveguide through a slot is heated more at one end of a segment (closer to a source) than at the other end (further from a source). Prior art structures have not made use of the slot's orientation as a means of addressing this problem. In a traditional serpentine waveguide, there is a field peak midway between two conducting surfaces. In the prior art, the slot is at this midway point. See, e.g., the disclosures of U.S. Pat. No. 3,471,672, U.S. Pat. No. 3,765,425, and U.S. Pat. No. 5,169,571.

A second problem relates to the distribution of the microwave energy. Because the magnitude of the electric field in a microwave signal has peaks and valleys due to forward and reverse propagation in the waveguide, planar materials fed through a slotted waveguide tend to experience hot spots. U.S. Pat. No. 3,765,425 (hereinafter, "the '425 patent") addresses this problem through the use of two disconnected waveguides that are interspersed with each other. At least one waveguide is equipped with a phase shifter to ensure that the hot spots in one waveguide occur at locations different than in the other waveguide. The disadvantage to this approach (aside from the expense of a phase shifter) is that sections of separate waveguide must lay on top of one another in order for planar materials to experience alternating hot spots as they pass through the entire structure. Furthermore, each distinct variation in phase requires an additional serpentine waveguide and an additional microwave source.

Another attempt to smooth out the effect of "hot spots" is disclosed in U.S. Pat. No. 5,536,921 (hereinafter, "the '921 patent"). Like the '425 patent, the '921 patent also depends on separate and distinct sections of waveguide. But instead of using one or more phase shifters, the '921 patent offsets its separated sections of waveguide by exactly a ¼ of a wavelength. The disadvantage of this approach is that it requires more than one phase-controlled path. The '921 patent requires even more paths than the '425 patent. According to the '921 disclosure, each waveguide section for exposing materials is a separate wave path. Each such section requires its own point for launching the wave and its own terminating point. Each launching point inevitably has losses due to signal reflection.

Most importantly, the approach disclosed in the '921 patent does not allow for easy adjustment to adapt to a variety of materials. It will be appreciated by those skilled in the art that the actual length of a ¼ wavelength is dependent on the material introduced into the waveguide. Therefore, the '921 patent teaches a device that must be built for a specific material. If the constructed device was used for a material with a different $\in_r$, the ¼ offset and its benefits would be reduced or completely eliminated. For example, if the structure disclosed in the '921 patent were used on a material whose $\in_r$ was different by a factor of 4 from the $\in_r$ of the material for which the structure was designed, then the material would be exposed to similarly placed (rather than offsetting) hot spots. It will be also appreciated by those skilled in the art that to further smooth out the effect of hot-spots, it may be advantageous to space hot spots by less than a ¼ of a wavelength. In sum, the '921 patent discloses only a ¼ of a wavelength offset and does not disclose a readily adjustable structure.

A third problem with traditional waveguides for electromagnetic exposure relates to the field gradient between top and bottom conducting surfaces. This gradient does not pose a problem if the planar material is of an insignificant thickness. However, if the planar material does have an appreciable thickness, this gradient can lead to nonuniform heating. One way to overcome this problem is disclosed in Applicants' co-pending application Ser. No. 08/813,061, now U.S. Pat. No. 5,998,774. This co-pending application, which is herein fully incorporated by reference, discloses the advantages of a dielectric slab-loaded structure that elongates the peak field region in a single mode cavity. However, slab-loaded structures have not yet been adapted for exposure of planar materials.

A fourth problem relates to leakage of microwaves through the slot of a slotted waveguide. Energy leakage and radiation is a general problem for any microwave structure. The problem of radiation through open access points is magnified when the material being passed through the structure has any electrical conductivity. Such conductive substances (e.g., any ionized moisture in paper that is passed through a chamber for drying) can, when passed through a microwave exposure structure, act as an antenna and carry microwaves outside the structure's cavity.

Currently in the art, two approaches are taken to address the problem of leakage through the slots of a slotted waveguide. One approach is to enclose the entire slotted waveguide in a reflective casing. See, e.g., the disclosure of U.S. Pat. No. 5,169,571. This approach has drawbacks. If the reflective casing does not itself have access points that remain open during the delivery of a microwave field, then the feed-through process must be fully automated and must exist inside the outer casing. On the other hand, if the reflective casing does have access points that remain open during the delivery of a microwave field—as does the structure disclosed in U.S. Pat. No. 5,169,571—then there is still a problem of leakage through those access points.

A second approach is the use of a reflective curtain draped over the slot. Although such a curtain may reduce leakage, it may also tend to obstruct smooth passage of any material that is fed through the slot. Any contact between such a curtain and any material tends to disrupt the surface tension of the material. Moreover, damaging arcing may occur between the curtain and the material. Furthermore, a reflective curtain does nothing to reduce the problem of an electrically conductive material's tendency to act as an antenna—alone or in combination with a waveguide's exterior conducting surface—and thus radiate energy through the slot.

Chokes that prevent the escape of electromagnetic energy from the cracks between two imperfectly contacting surfaces are well known in the art. Particularly well known are chokes designed for microwave oven doors and waveguide couplers. See, e.g., U.S. Reissue Pat. No. 32,664 (1988). What has not been fully explored in the art is the use of the choke flange concept to reduce leakage through arbitrarily shaped access points that remain open during delivery of a microwave field. Although choke flanges have typically been used to reduce leakages through two imperfectly contacting surfaces, the present invention and co-pending application Ser. No. 08/813,061, U.S. Pat. No. 5,998,774, incorporated herein by reference, each show that the choke flange concept can also be applied to leakage through arbitrarily shaped openings in a feed-through type structure.

SUMMARY OF THE INVENTION

The present invention overcomes many of the problems associated with electromagnetic exposure of planar materials. In a particular embodiment, a diagonal slot compensates for the effects of signal attenuation along the propagation path. The diagonal slot allows a planar material to experience a field that is more off-peak in regions of highest signal strength and less off-peak in regions of lowest signal strength.

In a second embodiment, adjustably variable path lengths allow the peaks and valleys of an electromagnetic field in one exposure segment to compensate for the peaks and valleys of the electromagnetic field in another exposure segment.

In a third embodiment, dielectric slabs extend the peak field region between the top and bottom conducting surfaces. This allows for more uniform heating of planar materials that have a significant thickness.

In a fourth embodiment, specialized choke flanges prevent the escape of electromagnetic energy from openings in a segment for electromagnetic exposure.

In a fifth embodiment, one or more rollers are placed between parallel exposure segments. These rollers may be enclosed by an outer surface to prevent the escape of electromagnetic energy. This surface forms a narrow section that limits escape of electromagnetic energy while allowing passage of planar materials.

BRIEF DESCRIPTION OF THE DRAWINGS

The present invention will now be described with reference to the accompanying drawings in which.

DETAILED DESCRIPTION OF PREFERRED EMBODIMENTS

Figure 1:
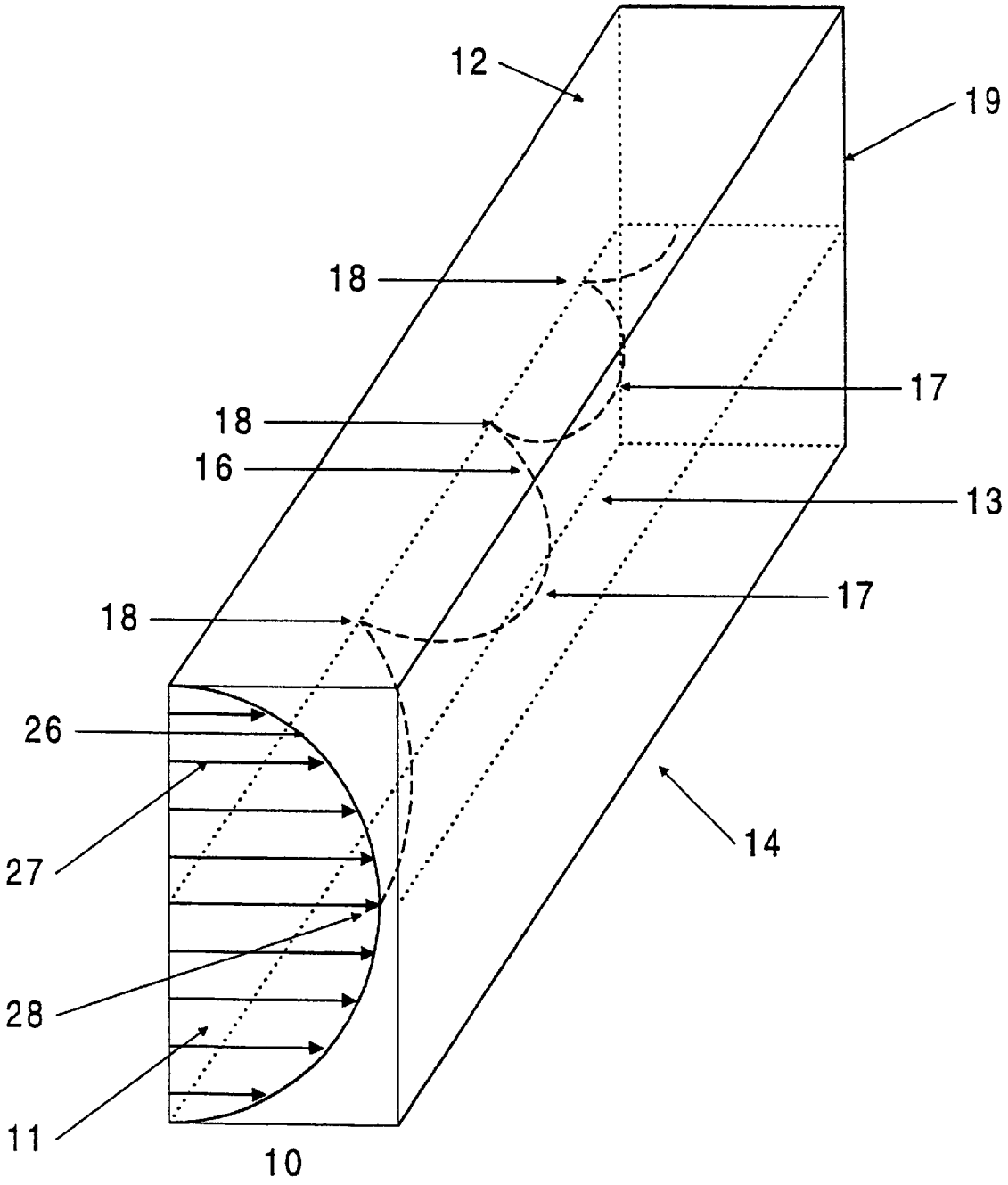
FIG. 1 is an illustration of a path for an electromagnetic wave.

Referring now to the drawings, FIG. 1 illustrates a path for an electromagnetic wave. The path 10 comprises a top conducting surface 12 and a bottom conducting surface 14. The conducting surfaces 12 and 14 can be a continuous surface or a perforated surface. Perforated surfaces enhance evaporation and/or allow moisture to drain through the bottom surface 14.

If an electromagnetic wave source (not shown) is attached to a first end 11 of the path 10, then an electromagnetic wave 16 propagates towards a second end 19 of the path 10.

The electromagnetic wave 16 has peaks 17 and valleys 18. If electromagnetic wave 16 is a traveling wave, then the location of the peaks 17 and the location of the valleys 18 will move along the path 10. However, if the second end 19 is shorted such that the electromagnetic wave 16 is a standing wave, then the location of the peaks 17 and the location of the valleys 18 are stationary.

The number of peaks 17 and the number of valleys 18 are a function of the length of the path 10, the frequency of the electromagnetic wave 16, and the dielectric constant of materials within the interior cavity 13.

It will be appreciated by those skilled in the art that when lossy materials are introduced into cavity 13 the magnitude of the peaks 17 decays exponentially as a function of the distance from the source (not shown) of the electromagnetic wave 16.

The electromagnetic wave 16 creates an electromagnetic field 26 between the top conducting surface 12 and the bottom conducting surface 14. The electromagnetic field 26 has a magnitude indicated by the horizontal arrows 27. The electromagnetic field 26 has a peak magnitude 28 at a point midway between the top conducting surface 12 and the bottom conducting surface 14 when the path 10 is operating in the lowest order mode of the waveguide $TE_{10}$.

Figure 2:
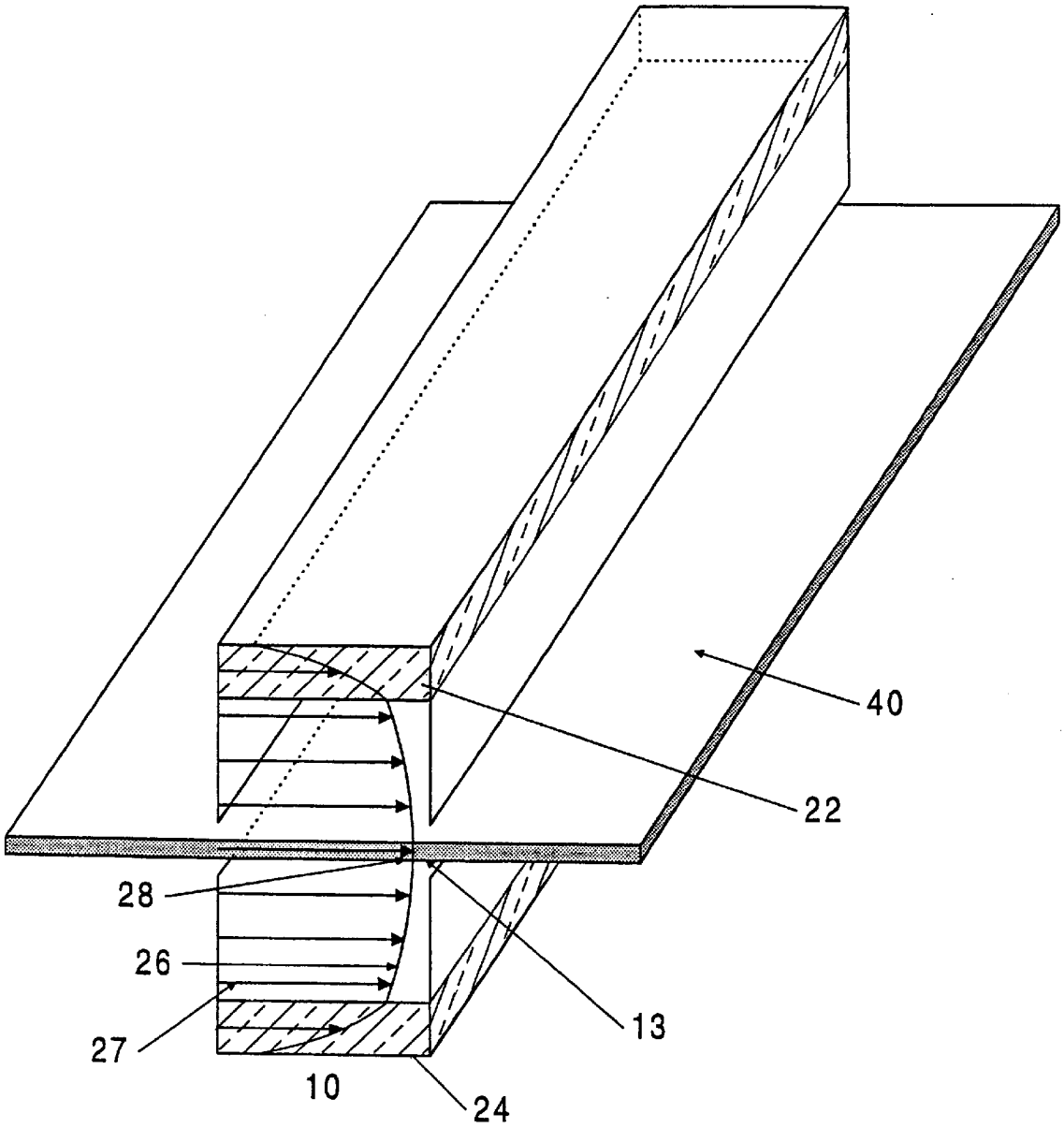
FIG. 2 is an illustration of a path with dielectric slabs.

FIG. 2 illustrates a path 10 with dielectric slabs 22 and 24. Cavity 13 is between dielectric slabs 22 and 24. As disclosed in co-pending application Ser. No. 08/813,061, now U.S. Pat. No. 5,998,774, dielectric slabs 22 and 24 create a more uniform electromagnetic field 26 in cavity 13. That is, the magnitude 27 at the top or the bottom edge of cavity 13 is closer in value to the peak value 28. Dielectric slabs 22 and 24 may be a ¼ of a wavelength of an electromagnetic field in the slab material. However, because the material passed through cavity 13 may be much thinner than the spacing between the top and bottom edge of cavity 13, dielectric slabs 22 and 24 will enhance exposure uniformity across the material's thickness even if the dielectric slabs 22 and 24 are not ¼ of a wavelength.

Figure 3:
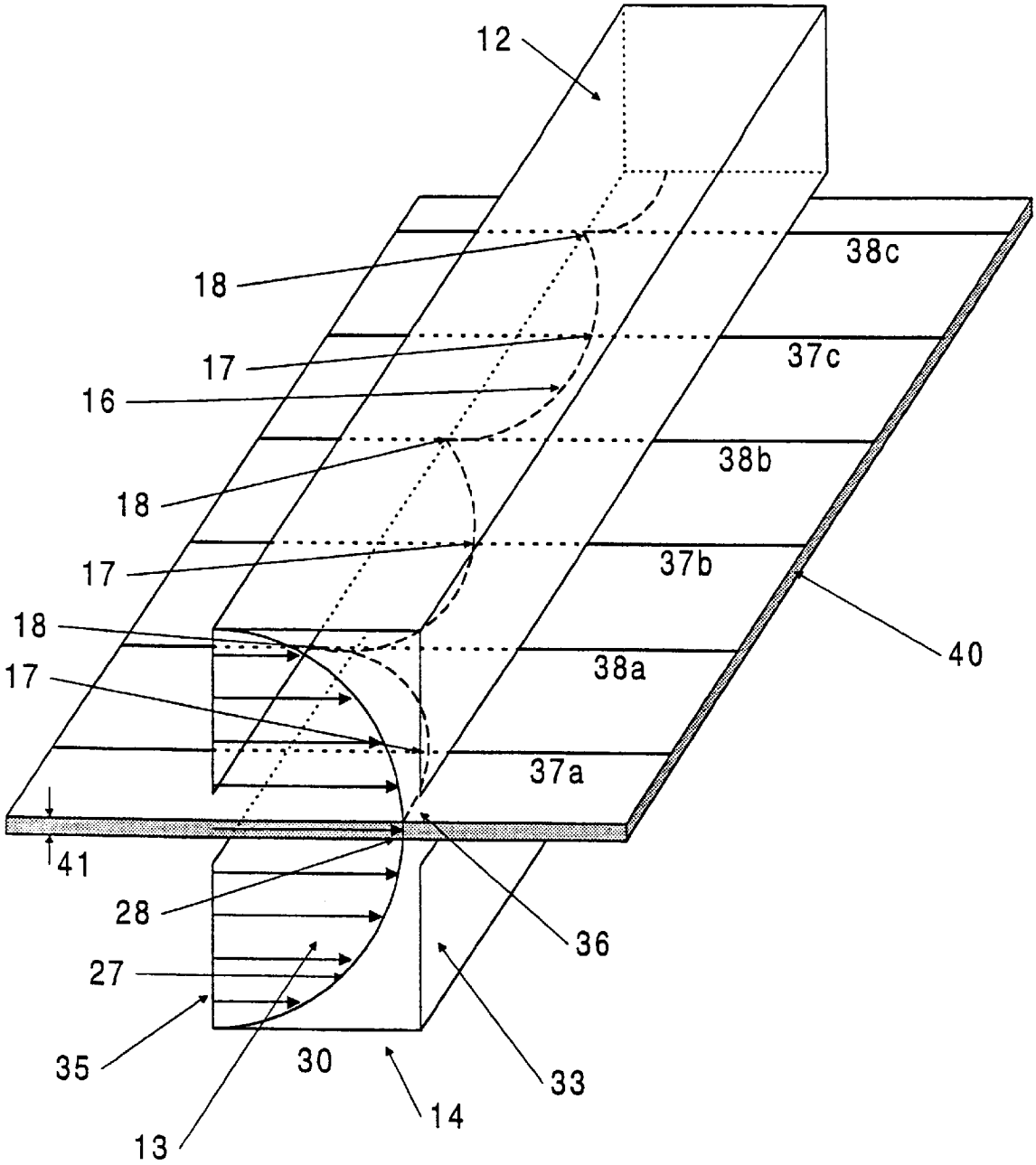
FIG. 3 is an illustration of a segment for electromagnetic exposure of a planar material.

FIG. 3 illustrates a segment 30 for electromagnetic exposure of a material 40. As shown in FIG. 3 the material 40 is a planar material. A planar material is any material or arrangement of materials that has a length and width that exceeds its thickness. While the disclosed invention is particularly suited for heating materials such as paper or fiberboard, it is equally usefull for heating potato chips, tobacco leaves, etc. It will be recognized by those skilled in the art that any non-planar material can be loaded or delivered by a tray, conveyor belt, or other means.

The segment 30 has a first conducting side 33 and a second conducting side 35. At least one of the sides 33 or 35 has an opening 36. The opening 36 can be of any shape, and run any or all of the length of the segment 30. If the second side 35 has a second opening 37, then the planar material 40 can pass completely through the interior cavity 13 of the segment 30.

The opening 36 needs to be thick enough to allow the planar material to pass through the first side 33. However, as the thickness of the opening 36 increases, the amount of electromagnetic energy that escapes through the opening 36 increases. Therefore, the optimum thickness of the opening 36 will depend on the thickness 41 of the planar material 40.

It will be appreciated by those skilled in the art that if the thickness of the planar material 40 is small relative to the distance between the top conductive surface 12 and the bottom conductive surface 14, then all of the planar material 40 is exposed to a magnitude 27 close to the peak value 28. However, if the thickness of the planar material 40 is large relative to the distance between the top conductive surface 12 and the bottom conductive surface 14, then the top and bottom edges of the planar material 40 are exposed to magnitudes 27 that are less than the peak value 28. Therefore, the use of dielectric slabs becomes increasingly important as the thickness 41 of the planar material increases.

If the opening 36 is at a point midway between the top conducting surface 12 and the bottom conducting surface 14, then the planar material 40 is exposed to the peak 28 of the electromagnetic field 26. If the opening 36 is not at a point midway between the top conducting surface 12 and the bottom conducting surface 14, then the planar material is exposed at least in part to a magnitude 27 less than the peak 28 of the electromagnetic field 26.

If the electromagnetic wave 16 is a standing wave, then the planar material along lines 37*a*, 37*b*, and 37*c* are exposed to peaks 17 of the electromagnetic wave 16. Similarly, the planar material along lines 38 are exposed to valleys 18 of the electromagnetic wave 16. The remainder of the planar material is exposed to magnitudes ranging between the peaks 17 and the valleys 18.

Assuming that the first end 11 of the segment 30 is closer to the source (not shown) of the electromagnetic wave 16, then the exposure along 37*c* is equal to or less than the exposure along line 37*a*. Even though the planar material 40 along line 37*c* is exposed to a peak 17 of the electromagnetic wave 16, the exposure along line 37*c* may, due to attenuation, be less than along lines corresponding to previous peaks.

Figure 4A:
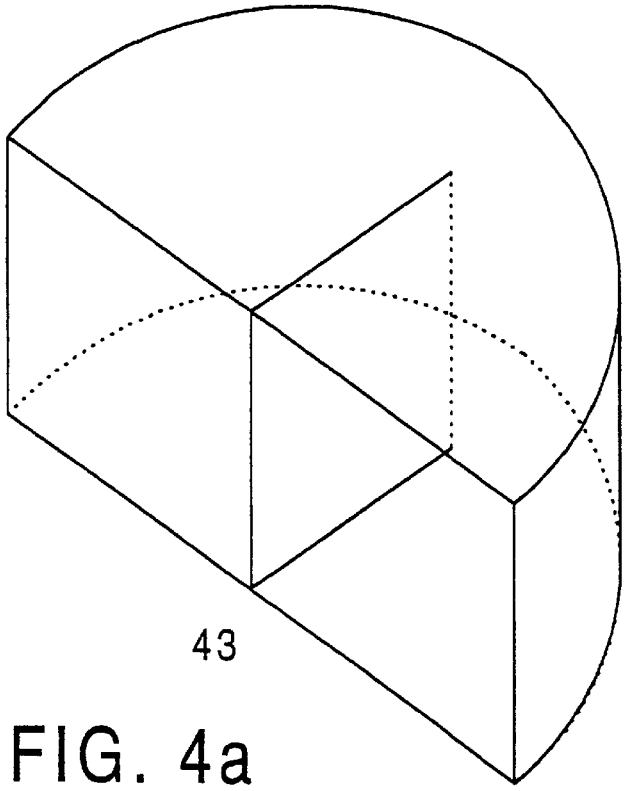
FIG. 4 is an illustration of a curved segment.
Figure 4B:
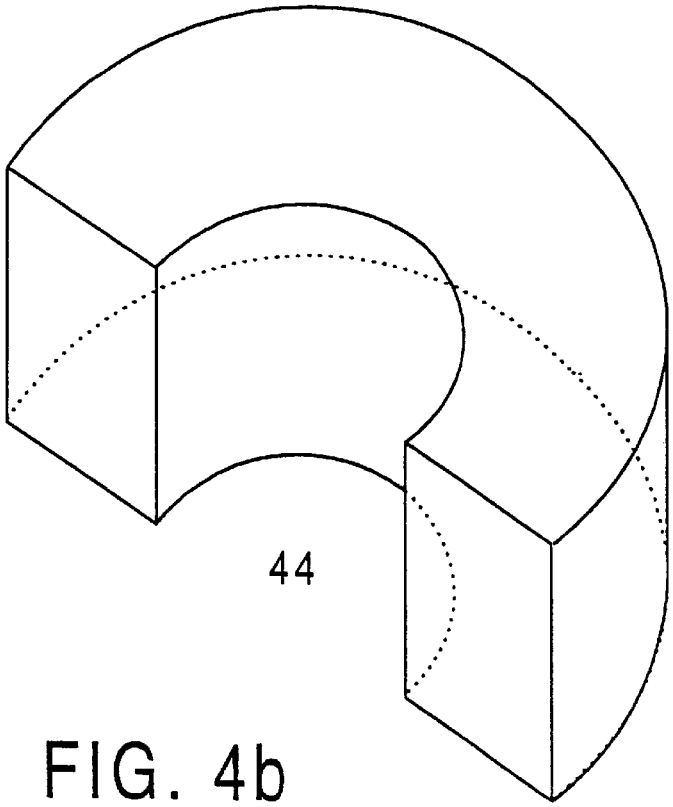

FIG. 4*a* illustrates a curved segment 43. FIG. 4*b* illustrates another curved segment 44. One or more curved segments 43 or 44 may be used to connect two or more exposure segments 30. Curved segments act as an extension of path 10 for electromagnetic wave 16. Thus, adjusting the length of a curved segment 43 or 44 affects the overall length of the wave's path. It will be appreciated by those skilled in the art that curved segment 44 is necessary if the exposure segments 30 are spaced apart.

Figure 5:
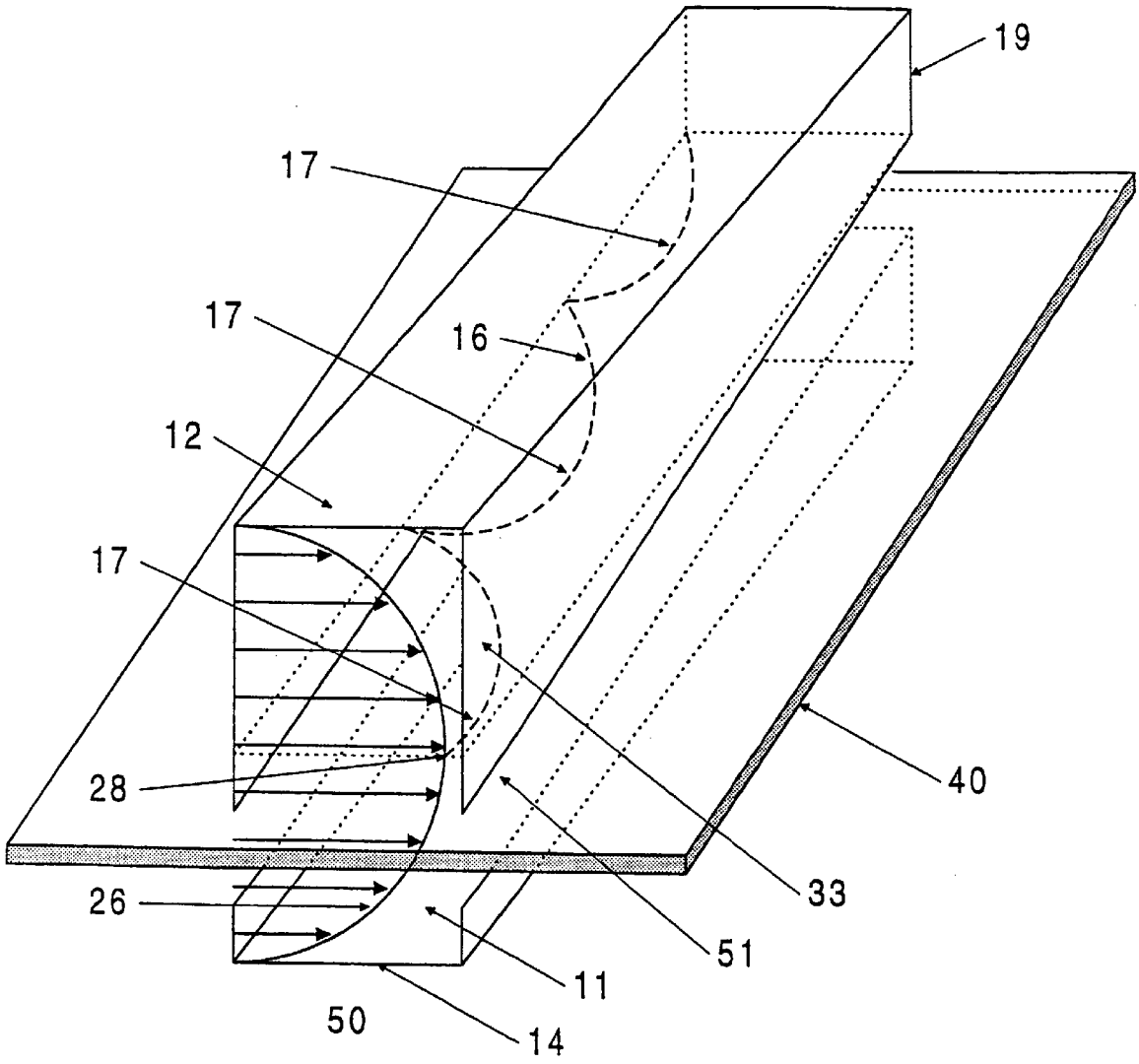
FIG. 5 is an illustration of a segment for electromagnetic exposure of a planar material with an opening in accordance with the present invention.

FIG. 5 illustrates an embodiment of the present invention that compensates for attenuation of electromagnetic wave 16. Exposure segment 50 has a diagonal opening 51. Note that opening 51 is diagonal relative to side 33 of exposure segment 50, but opening 51 may or may not be parallel to a floor of a room (not shown). The value of a diagonal opening 51 is that it promotes more even heating by setting two different variations in electromagnetic exposure against each other. The first variation is between the top and bottom conducting surface of an exposure segment. This is illustrated in by the shape of electromagnetic field 26 as shown on FIG. 5. Electromagnetic exposure in a given cross section of segment 50 is less near top and bottom conducting surfaces 12 and 14 than it is near a midway point between surfaces 12 and 14.

The second variation in electromagnetic exposure is between an end of the waveguide nearer the source and an end of a waveguide further from the source. This variation occurs when the planar material 40 is lossy. This variation is illustrated by the attenuated peaks 17 of electromagnetic wave 16 as shown in FIG. 5. At end 11, nearer the source (not shown), peaks 17 are higher than they are at end 19.

Diagonal opening 51 sets these two variations against each other in the following manner: Assuming end 11 is nearer the source (not shown), the material 40 is introduced through an opening 51 that is further from peak 28 at end 11 than at end 19. In other words, where material 40 is nearer the source (not shown) it should be further from peak 28; where material 40 is farther from the source (not shown) it should be closer to peak 28.

Figure 6:
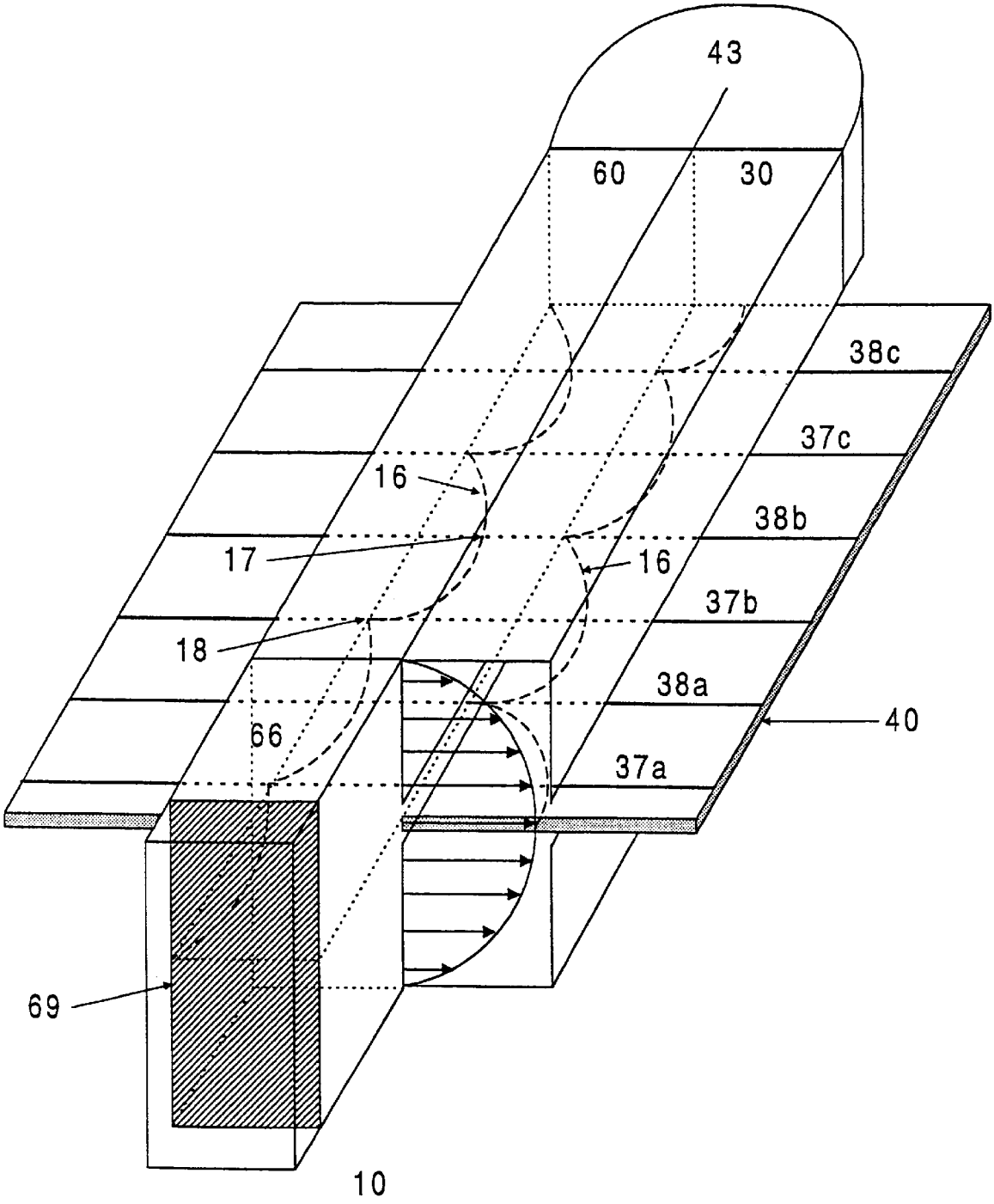
FIG. 6 is an illustration of a combination of exposure segments and curved segments in accordance with the present invention.

FIG. 6 illustrates an embodiment of the present invention that compensates for the peaks and valleys of the electromagnetic wave in a given exposure length.

The curved segment 43 connects the exposure segment 30 and an exposure segment 60. The length of exposure segment 43 is defined by the length of the portion of path 10 (of which segment 43 is a part) between exposure segment 30 and exposure segment 43. The exposure segment 60 connects to a termination segment 66 that has a terminating point 69. The length of segment 66 is defined as the length of the portion of path 10 (of which segment 66 is a part) between point 69 and segment 60. The length of segment 60 may be zero units (point 69 right at end of segment 60) or greater than zero units.

In exposure segment 30, the planar material 40 is exposed to an electromagnetic wave 16. The electromagnetic wave 16 has peaks 17 and valleys 18. If point 69 is a short circuit, electromagnetic wave 16 is a standing wave and the locations of the peaks 17 and the valleys 18 are stationary. In this case, as material 40 passes through segment 30, it is exposed to peaks 17 in the electromagnetic wave 16 along a given set of lines 37*a*, 37*b*, and 37*c*; also as it passes through segment 30, planar material 40 is exposed to valleys 18 along another given set of lines 38*a*, 38*b*, and 38*c*. These alternating peaks 17 and valleys 18 of the electromagnetic wave 16 in segment 30 tend to create hot spots along lines 37 of planar material 40 and cold spots along lines 38 of planar material 40.

Material 40 may be heated more uniformly by offsetting the exposure peaks in segment 30 with exposure valleys in segment 60 and, correspondingly, offsetting the exposure valleys in segment 30 with exposure peaks in segment 60. In other words, along lines 37, the planar material should be exposed to peaks in segment 30 and valleys in segment 60; and along lines 38 the planar material should be exposed to valleys in segment 30 and peaks in segment 60. This may be accomplished by recognizing that the location of peaks and valleys in segment 30 relative to the location of peaks and valleys in segment 60 is a function of the combined length of segments 30, 43, 60 and 66.

The exact combined length of segments 30, 43, 60, and 66 that will produce the offsetting peaks and valleys just described will depend on both the type of point in termination segment 66 and the properties of planar material 40. In order to make the embodiment illustrated in FIG. 6 easily adaptable to variations in the properties of planar material 40, two alternatives are suggested.

First, if segment 66 is to terminate in a short circuit, methods well known in the art may be employed to make the location of the short readily adjustable. For example, point 69 may be a slidable conducting plate. If the length of segment 66 is defined as the distance between conducting plate 69 and segment 60, then the length of segment 66 may be adjusted by simply sliding the conducting plate 69. It will be appreciated by those skilled in the art that the boundary condition at a short circuit means that wave 16 will have a valley at plate 69. It will be further appreciated that as plate 69 slides either towards segment 60 or away from segment 60, the standing wave 16, along with its peaks 17 and valleys 18, will be in a sense "pulled" or "pushed" along segments 66, 60, 43, and 30.

An analogy may be made to a rope on a pulley where the rope has a series of knots. If wave 16 is the rope, peaks 17 are the knots, plate 69 is an anchor point, and segment 43 is the pulley, then, by analogy, the knots (peaks) on one side of the pulley (the wave peaks in segment 30) may be aligned to offset the knots on the other side of the pulley (the wave peaks in segment 60) by simply pulling or pushing the rope (wave 16) around the pulley (segment 43) by moving its anchor point (adjusting the location of plate 69).

A second alternative for adjusting the combined length of segments 30, 43, 60, and 66 is to make the length of segment 43 readily adjustable. This may be accomplished by making segment 43 readily replaceable with longer length segments. It may also be accomplished by connecting segment 43 to segments 30 and 60 in such a way that segment 43 may slide into segments 30 and 60, just as a slide on a trombone makes the effective length of the trombone's airway readily adjustable. The effect of adjusting the length of segment 43 may be visualized by returning to the rope/pulley analogy. In this case, electromagnetic source (not shown) may be compared to a feed point or spool of rope and the plate 69 may again be compared to a point to which the rope is anchored. Segment 43 is again the pulley. Increasing the length of segment 43 is analogous to raising the height of the pulley. If the rope (wave 16) is anchored at a point (plate 69), then, as the pulley is raised (segment 43 is lengthened), rope (wave 16) will feed from the spool (electromagnetic source, not shown), and the position of knots on one side of the pulley (position of peaks 17 in segment 30) will adjust relative to the position of knots on the other side of the pulley (position of peaks 17 in segment 60).

If the combined length of segments 30, 43, 60, and 66 is made adjustable in either of the ways described above, then one skilled in the art may adapt the present invention for use with a variety of planar materials without undue experimentation.

Figure 7A:
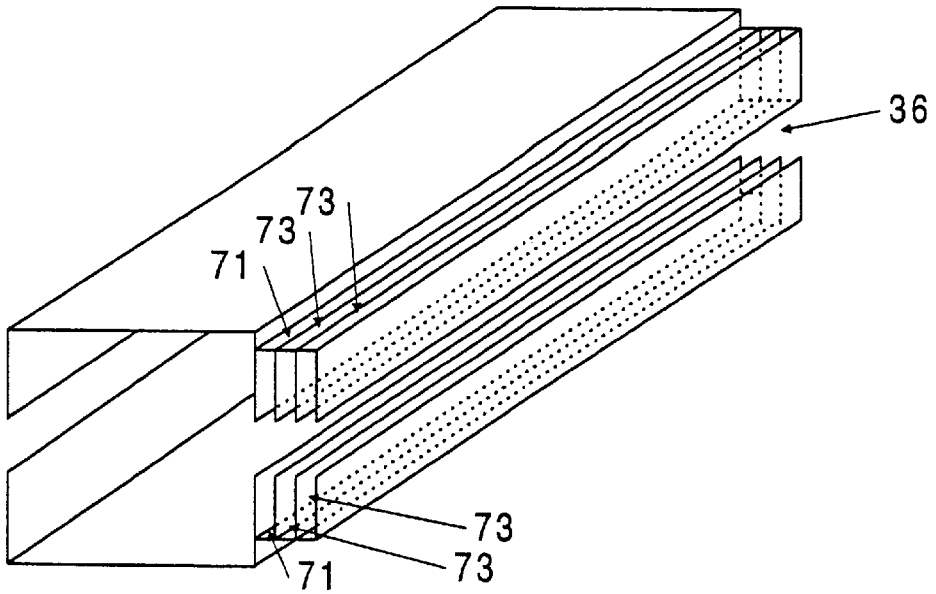
FIG. 7 is an illustration of an opening with a choke flange in accordance with the present invention.
Figure 7B:
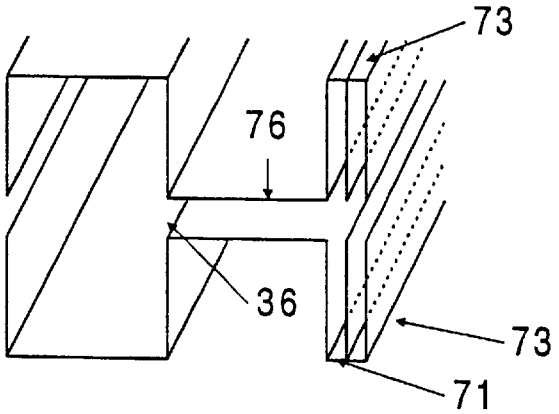

FIG. 7*a* illustrates an opening 36 with a choke flange 71 to prevent the escape of electromagnetic energy through the opening 36. Choke flange 71 may consist of a hollow or dielectrically filled conducting structure. Choke flange 71 is short circuited at a distance d of $\lambda/4$ from the outer perimeter of the opening 36. It will be appreciated by those skilled in the art that to further prevent the escape of electromagnetic energy, narrow extension 76 can be added between the segment 30 and the choke flange 71 as show in FIG. 7*b*. In a preferred embodiment, the narrow extension 76 should be a thickness less than a half of the wavelength corresponding to the operating frequency.

Figure 7C:
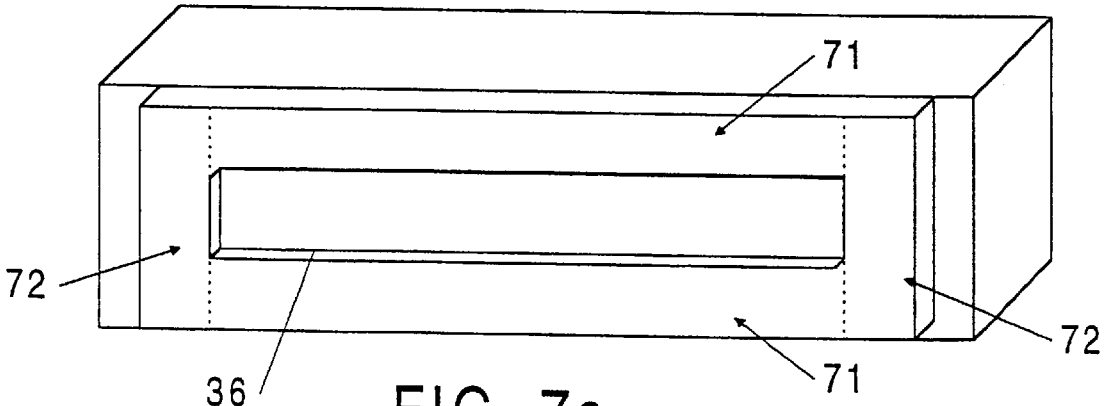

FIG. 7*c* illustrates an opening 36 with a choke flange 71 that has sections 72. If the thickness of opening 36 is small, then there is no need for choke flange 71 to have sections 72. However, for thicker openings, sections 72 should be added and shorted a distance d equal to $\lambda/4$ from the outer perimeter of opening 36. Note that $\lambda/4$ is measured with reference to the operating frequency and the value of the relative dielectric constant $\in_r$ of the material inside the hollow or dielectrically filled choke flange 71. Although ideally the distance d should be equal to $\lambda/4$, choke flange 71 will still operate in accordance with the present invention if d is slightly greater or slightly less than $\lambda/4$.

If desired, additional choke flanges 73 may be "stacked" on top of choke flange 71. As long as these choke flanges are also shorted at a distance d equal to $\lambda/4$ from opening 36's outer perimeter, they will help minimize leakage of electromagnetic energy through opening 36. The shorting distance d for additional choke flanges may be made slightly greater or slightly less than $\lambda/4$ with reference to the expected operating frequency. In an arrangement of multiple choke flanges, a variety of shorting distances may help compensate for slight variations in the actual operating frequency of a particular electromagnetic source.

Figure 8:
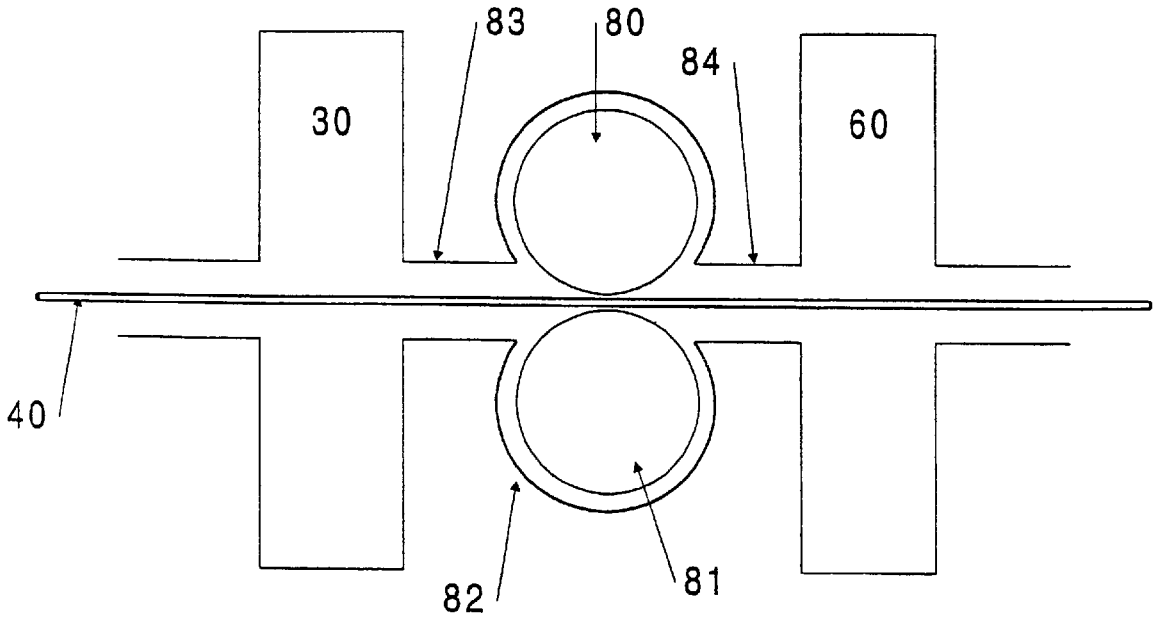
FIG. 8 is an illustration of a further embodiment of the present invention.

FIG. 8 illustrates a further embodiment of the present invention wherein roller 80 and roller 81 are placed between exposure segment 30 and exposure segment 60. Rollers 80 and 81 may be enclosed by an exterior surface 82 to prevent the escape of electromagnetic energy. Sections 83 and 84 are narrow enough that the electromagnetic wave 16 (shown in previous FIGS.) does not easily enter sections 83 and 84 and cause unwanted electromagnetic exposure of the rollers 80 and 81. It will be appreciated by those skilled in the art that the rollers 80 and 81 might be damaged by electromagnetic energy. Of course, if the rollers 80 and 81 were located in the segment 30 or the segment 60, they would likely disrupt the field, shown in previous FIGS.

Exposure segment 30 and exposure segment 60 are connected by a curved segment 44 that allows spacing for roller 80 and/or roller 81 between exposure segment 30 and exposure segment 60. The distance between exposure length 30 and exposure length 60 will depend or the size roller 80 or roller 81. Rollers 80 and 81 can be active or passive. That is, roller 80 and/or roller 81 may actually propel material 40 towards exposure segment 60 or may merely stabilize material 40.

Figure 9:
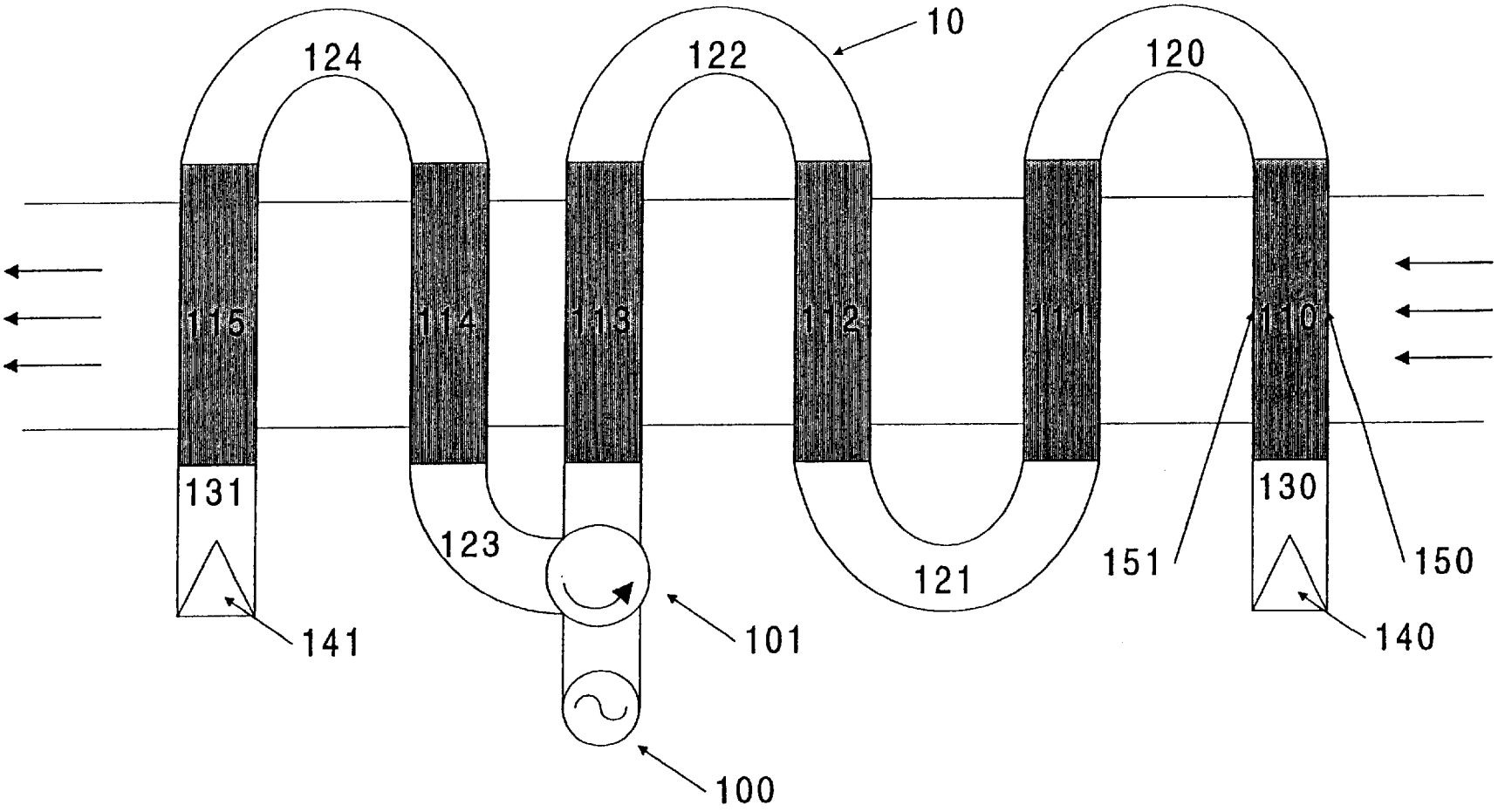
FIG. 9 is an illustration of another embodiment of the present invention.

FIG. 9 illustrates another embodiment of the present invention. A microwave generator 100 provides an electromagnetic wave 16 to the path 10. The path 10 comprises exposure segments 110–15, curved segments 120–124, termination segments 130 and 131, and point 140 and load 141. In a preferred embodiment segments 110–115 are perforated to facilitate evaporation and allow run off of moisture.

The circulator 101 initially provides electromagnetic wave 16 to exposure segment 113. The electromagnetic wave 16 propagates along the path 10 until it reaches point 140. If point 140 is short circuit, the reflection of electromagnetic wave 16 creates a standing wave. Only the reflection of electromagnetic wave 16 from point 140 is allowed to propagate to exposure segment 114 and then to exposure segment 115 until it reaches load 141. The reflection of the electromagnetic wave 16 creates a standing wave. Alternatively, load 141 can be placed closer to the circulator 101.

Material 40 enters exposure segment 110 via an opening 150. Opening 150 has choke flanges 170. In exposure segment 110, material 40 is exposed to peaks 17 along lines 37 and valleys 18 along lines 38 (as shown in FIG. 6). Material 40 exits exposure segment via opening 151. Material 40 enters exposure segment 111 via an opening 152. In exposure segment 111, planar material 40 is exposed to valleys 18 along lines 37 and peaks 17 along lines 38.

The length of termination segments 130 and 131 are adjustable by moving the position of points 140 and load 141 respectively. By adjusting the lengths of termination segments 130 and 131, one skilled in the art can achieve more uniform heating.

In a preferred embodiment, exposure segment 113 and exposure segment 114 project downward as shown in FIG. 5. As a result, the material 40 in segment 113 and 114 that is closest to the source 100 is farthest from the peak of the field 26 (shown in previous FIGS.). The material 40 that is the farthest from the source 100 is the closest to the peak magnitude of the field 26. Exposure segment 112 projects upward to achieve the same effect. That is, the material 40 in segment 112 that is closest to the source 100 is farthest from the peak of the field 26. The material 40 that is the farthest from the source 100 is the closest to the peak magnitude of the field 26.

Figure 10:
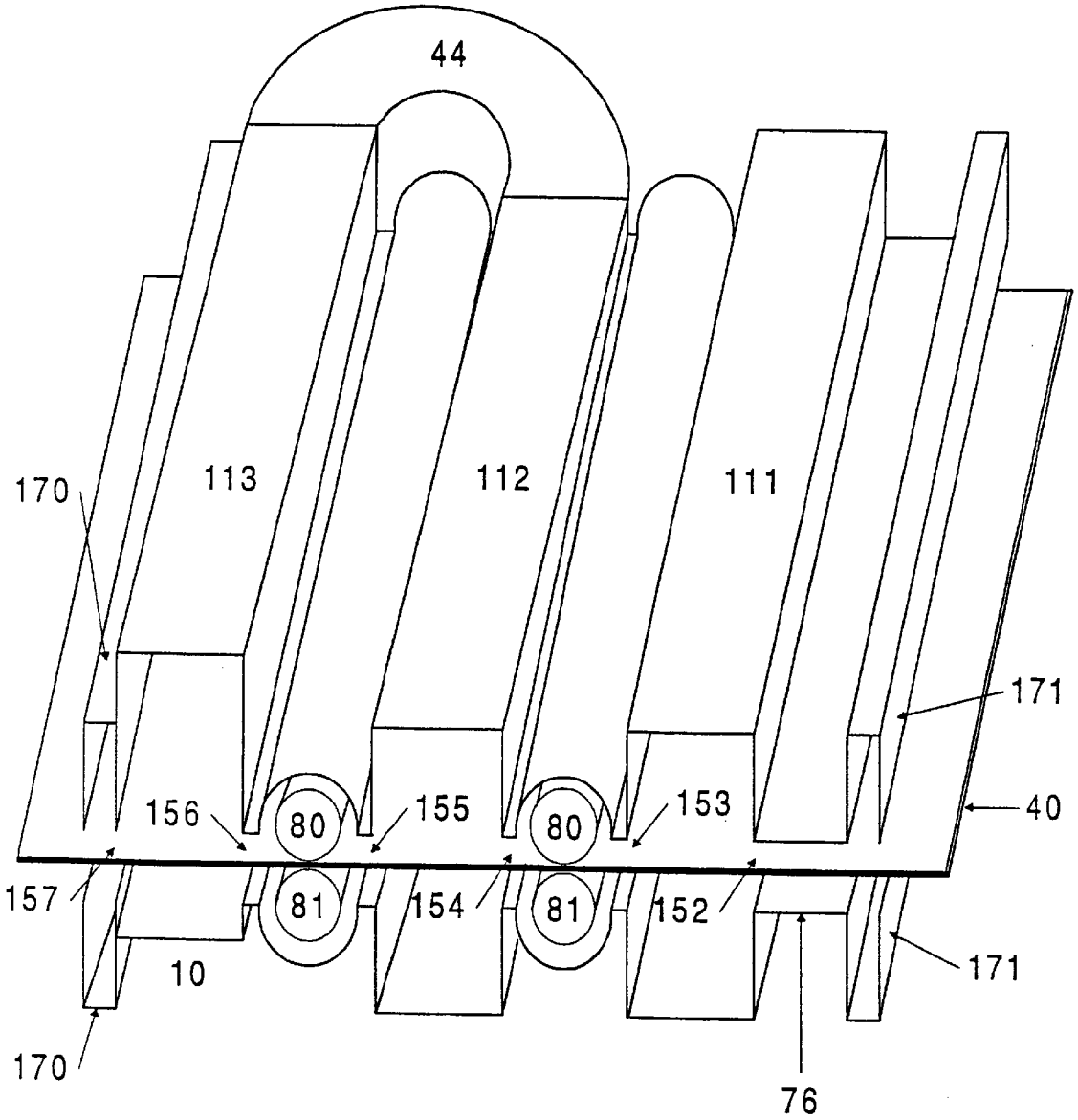
FIG. 10 is an illustration of another embodiment of the present invention.

FIG. 10 illustrates a further embodiment of the present invention. A microwave generator as shown in FIG. 9 provides an electromagnetic wave 16 (shown in previous FIGS.) to the path 10. The path 10 comprises exposure segments 111, 112, and 113 and curved section 44. An additional curved section (not shown) connects segment 112 to segment 113. The source provides electromagnetic wave 16 to exposure segment 113. The electromagnetic wave 16 propagates along the path 10 until it reaches a terminating point (not shown). The reflection of electromagnetic wave 16 creates a standing wave.

Material 40 enters exposure segment 113 via an opening 157. Opening 157 has choke flanges 170. Exposure segment 113 projects downward so that material 40 in segment 113 that is closest to the source is farthest from the peak of the field 26. The material 40 that is the farthest from the source is the closest to the peak of the field 26.

Material 40 exits exposure segment 113 via an opening 156. Material 40 passes through rollers 80 and 81. Material 40 enters exposure segment 112 via an opening 155. Exposure segment 112 projects upward such that material 40 in segment 112 that is closest to the source is farthest from the peak of the field 26. The material 40 that is the farthest along the path from the source is the closest to the peak of the field 26. Material 40 exits segment 112 via an opening 154. Material 40 passes through a second set of rollers 80 and 81. Material 40 enters segment 111 via an opening 153 and exits segment 111 via an opening 152. Finally, material 40 passes through a narrow section 76 that has choke flanges 71.

Numerous variations or modifications of the disclosed invention will be evident to those skilled in the art. While the foregoing description makes reference to particular illustrative embodiments, this patent is intended to cover all variations or modifications that do not depart from the spirit and scope of the disclosed invention.

We claim:

1. A device for electromagnetic exposure, comprising:

a path for an electromagnetic wave;

the path having a first segment for electromagnetic exposure of a material, a second segment, a third segment for electromagnetic exposure of the material, and a fourth segment;

wherein a combined length of the first segment, the second segment, the third segment, and the fourth segment are such that peaks of an electromagnetic wave occur at a different set of points in the first segment than in the third segment.

2. A device as described in claim 1, wherein at least one of the segments for electromagnetic exposure has a first end, a second end, a top conducting surface, a bottom conducting surface, and an opening for introducing the planar material to an interior region of said segment;

the opening being such that the planar material is exposed to an electromagnetic field between the top conducting surface and the bottom conducting surface that is more off-peak at the first end than at the second end.

3. A device as described in claim 1 wherein at least one of the segments has a top conducting surface, a top dielectric slab, a bottom conducting surface, a bottom dielectric slab, and a side surface, the side surface having an opening for introducing a material into an interior region between the dielectric slabs.

4. A device for electromagnetic exposure, the device comprising:

a path for an electromagnetic wave;

the path having at least one segment for electromagnetic exposure of a material;

said segment having an opening for introducing the planar material to an interior region of said segment;

the opening having a choke flange for preventing escape of electromagnetic energy from the interior region wherein the choke flange is connected to an exterior surface to create a short circuit at an outside edge of the choke flange and an open circuit at the opening.

5. A device as described in claim 4, wherein the opening is a rectangular opening with four sides and the choke flange creates an open circuit at all four sides of the opening.

6. A method for exposing a material to electromagnetic energy comprising the steps of:

passing the material through an interior cavity of at least two exposure segments;

delivering an electromagnetic wave to each interior cavity;

and adjusting a combined length of the at least two exposure segments, a connecting segment and a termination segment so that peaks of the electromagnetic wave occur at a different set of points in a first exposure segment than in a second exposure segment.

7. A device for heating a material, the device comprising:

a path for an electromagnetic wave, the path having a first segment and a second segment, the first segment and the second segment connected by a curved segment;

the combined length of the first segment, the curved segment, and the second segment such that peaks of the electromagnetic wave occur at a different set of points in the first segment than in the second segment.

8. A device as described in claim 7, wherein the first segment and the second segment each having an opening, the opening to the first segment aligned with the opening to the second segment so that the material can travel through the first segment and the second segment.

9. A device as described in claim 8, wherein the material travels through the first segment and the second segment in a direction substantially perpendicular to the propagation of the electromagnetic wave in the first segment.

10. A device as described in claim 8, the first segment and the second segment each having at least two conducting surfaces, the electromagnetic wave creating a electromagnetic field between the two conducting surfaces.

11. A device as described in claim 10, the opening to the first segment positioned such that the material is exposed to an off-peak region of the electromagnetic field between the two conducting surfaces of the first segment.

12. A device as described in claim 11, wherein the first segment has a first end and a second end, the first end closer to the source, and the opening to the first segment is positioned such that the material is exposed to a more off-peak region of the electromagnetic field at the first end of the first segment than at the second end of the first segment.

13. A device as described in claim 12, wherein the material travels through the first segment and the second segment in a direction substantially perpendicular to the propagation of the electromagnetic wave in the first segment.

14. A device as described in claim 12, wherein the second segment has a first end and a second end, the first end closer to the source, and the opening to the second segment is positioned such that the material is exposed to a more off-peak region of the electromagnetic field at the first end of the second segment than at the second end of the second segment.

15. A device as described in claim 14, wherein the material travels through the first segment and the second segment in a direction substantially perpendicular to the propagation of the electromagnetic wave in the first segment.

16. A device as described in claim 14, wherein the curved segment connects the second end of the first segment to the first end of the second segment.

17. A device as described in claim 16, wherein the material travels through the first segment and the second segment in a direction substantially perpendicular to the propagation of the electromagnetic wave in the first segment.

* * * * *